US007051691B2

(12) United States Patent
Battlogg

(10) Patent No.: US 7,051,691 B2
(45) **Date of Patent: *May 30, 2006**

(54) DESMODROMIC VALVE DRIVE

(76) Inventor: Stefan Battlogg, Haus NR. 166, A-6771St. Anton/Montafon (AT)

( * ) Notice: Subject to any disclaimer, the term of this patent is extended or adjusted under 35 U.S.C. 154(b) by 0 days.

This patent is subject to a terminal disclaimer.

(21) Appl. No.: 10/680,821

(22) Filed: Oct. 7, 2003

(65) Prior Publication Data

US 2004/0177821 A1 Sep. 16, 2004

Related U.S. Application Data

(63) Continuation of application No. PCT/AT01/00405, filed on Dec. 27, 2001.

(30) Foreign Application Priority Data

Apr. 9, 2001 (AT) ..... A 566/2001

(51) Int. Cl.
*F01L 1/30* (2006.01)

(52) U.S. Cl. ..... 123/90.26; 123/90.24; 123/90.15; 123/90.16; 123/90.41; 123/90.6; 74/567; 251/251

(58) Field of Classification Search .. 123/90.15–90.17, 123/90.39–90.41, 90.6, 90.31, 90.24–90.26; 251/251, 256, 257; 74/567, 569
See application file for complete search history.

(56) References Cited

U.S. PATENT DOCUMENTS

| | | | | |
|---|---|---|---|---|
| 1,238,175 | A * | 8/1917 | Moore | 123/90.26 |
| 1,937,152 | A | 11/1933 | Jünk | |
| 2,858,818 | A * | 11/1958 | Bailey | 123/90.26 |
| 5,058,540 | A * | 10/1991 | Matsumoto | 123/90.17 |
| 6,705,262 | B1 * | 3/2004 | Battlogg | 123/90.26 |
| 6,796,277 | B1 * | 9/2004 | Battlogg | 123/90.26 |
| 6,802,287 | B1 * | 10/2004 | Battlogg | 123/90.16 |
| 2002/0073947 | A1 | 6/2002 | Battlogg | |

FOREIGN PATENT DOCUMENTS

| | | |
|---|---|---|
| DE | 37 00 715 A1 | 7/1987 |
| GB | 741831 | 12/1955 |
| WO | 01/12958 A1 | 2/2001 |

OTHER PUBLICATIONS

English translation of German Patent DE3700715, Pundt et al., Jul. 23, 1987, consisting of three pages.*

* cited by examiner

*Primary Examiner*—Thomas Denion
*Assistant Examiner*—Kyle M. Riddle
(74) *Attorney, Agent, or Firm*—Laurence A. Greenberg; Werner H. Stemer; Ralph E. Locher

(57) ABSTRACT

The invention relates to a valve drive, in particular for internal combustion engines of motor vehicles, comprising at least one cam element (2) that is located on a driven shaft (1) and at least one lifting valve (10), which has a valve stem (11) and can be displaced by the cam element (2). The cam element (2) is pivotally mounted inside a flexible encapsulation element (4), which is connected to one end of the valve stem (11). The end of the valve stem (11) is guided in the displacement direction of the valve (10).

32 Claims, 14 Drawing Sheets

DESMODROMIC VALVE DRIVE

CROSS-REFERENCE TO RELATED APPLICATION

This application is a continuation of my copending International Application PCT/AT01/00405, dated Dec. 27, 2001, which designated the United States and which was published in a language other than English.

BACKGROUND OF THE INVENTION

Field of the Invention

The invention relates to a valve drive, especially for internal combustion engines of motor-powered devices, motor vehicles, or the like, having at least one cam element disposed on a driven shaft and having at least one lift valve which is displaceable by the cam element and has a valve stem, the cam element being arranged rotatably within a flexible enclosing element connected to one end of the valve stem, and further relates to a cylinder head for such a valve drive.

A valve drive of this type can be derived, for example, from WO-01/12958-A. In FIG. 7, the cam element is arranged alongside the valve and the cylinder head (not shown) can be built somewhat lower compared with a construction represented in FIG. 5 or 6 of WO-01/12958-A.

Critical to the height of the cylinder head is the length of the slideway of the lift valve, which must not fall below a specific measure and is also partly determined by the diameter of the valve stem, since the forces acting upon the valve in the opening motion contain a lateral component.

The desmodromic valve control system dispenses with heavy valve springs and allows a lighter construction of the camshaft and valve drives, so that even the height of the cylinder head might further be reduced. However, the minimum length of the slideway precludes this. The above considerations apply generally to all internal combustion engines, since a lighter construction, for example, reduces fuel consumption. Special importance is given to the height of the cylinder head and, hence, the height of the entire engine, particularly in motor racing, where a lighter construction which economizes on structural height places the center of gravity lower down and impacts critically upon roadholding and vehicle handling.

SUMMARY OF THE INVENTION

The invention set out therefore to create a valve drive of the type stated in the introduction with improved guidance for the lift valves and achieves this by virtue of the fact that that end of the valve stem which is connected to the enclosing element is guided in the direction of displacement of the valve. The entire upper part of the valve stem is thereby able to be incorporated into the guide length dimension. It has been shown that, if the cylinder head height remains constant, more than double the guide length is attainable compared with the known valve drives. The height of the cylinder head can therefore be reduced, so that the arrangement and accommodation of the inlet and outlet duct to be operated by the lift valve emerges as the critical criterion initially to the length of the guide.

In a first preferred embodiment, it is envisaged that a holder is configured between the enclosing element and the valve stem, which holder has sliding surfaces which can be guided on cylinder-head-fixed guide surfaces.

Depending on the configuration of the holder as the connecting point between the enclosing element and the valve stem, sliding surfaces can be provided on different parts of the holder or of the valve itself. A first embodiment envisages that the holder projects over the cam element in the axial direction of the shaft and the sliding surfaces are provided on the projecting region of the holder. Even if the valve arrangement is central and well aligned, the guide of the holder is in itself sufficient to produce, axially next to the cam element, a substantial shortening of the structural height.

In a second embodiment it is envisaged that the cam element has two axially spaced cam regions and, between these, a groove disposed in extension of the sliding surfaces of the holder, the enclosing element, in the holding region for the valve stem, having a slot corresponding with the groove. In this embodiment, the cam element and guide elements provided on the cylinder head penetrate each other, the width of which guide elements maximally corresponds to the width of the groove, so that the guide of the holder and of the valve stem can also approach close to the carrier shaft.

In a first preferred embodiment, the holder provided with the sliding surfaces comprises a bearing sleeve in the enclosing element and a hinge pin connected to the valve stem, which hinge pin is rotatably mounted in the bearing sleeve. The sliding surfaces can be configured on the hinge pin.

For the connection between the hinge pin and the end of the valve stem, the hinge pin can be assigned a connecting part, which is connected to the valve stem and is provided with the sliding surfaces. The hinge pin and the connecting part can be arranged in L-shape or in T-shape, the valve stem, for example, being screwed, or the like, into the connecting part protruding from the hinge pin. The T-shape of the holder is especially usable in those embodiments in which the cam element has a groove.

The connecting part can also be of fork-shaped configuration or can be assembled from two L-shaped parts connected to the hinge pin. In this embodiment, a transverse part or two transverse members additionally connected to the valve stem extend parallel to the hinge pin in order to increase the strength of the connection.

In a further embodiment it is envisaged that the valve stem is offset in relation to the cam element in the axial direction of the shaft. The axially projecting region of the holder can then be fastened to the upper part of the valve stem and can have for this purpose a bore, the axis of which lies in the axis of the valve stem. The upper end of the valve stem can be provided with a threaded bore, in which a fastening screw passing through the bore of the holder engages. In order to make the fastening screw accessible, in this embodiment the driven shaft of the valve drive running thereabove is preferably provided with a bore through which a helical spring or the like can be brought up to the fastening screw of the valve stem. Insofar as the carrier shaft is hollow and is used for the supply of oil to that peripheral surface of the cam element which is covered by the enclosing element, a core barrel is drawn through the driven shaft following the fastening and adjustment of all valve stems, which core barrel covers from inside the access bores for the fastening screws.

In a further preferred embodiment, the bore, in the axially projecting region of the holder provided with the sliding surfaces, is a threaded bore, and the upper end of the valve stem has a thread which is screwed into the holder. Here, too, the valve stem can be adjusted and fixed through a corresponding bore of the carrier shaft, for example using a counter screw inserted from above. In place of the screw connection, other connection options are also conceivable, for example pressing, squeezing, clamping, connection by means of a transverse pin, etc.

An especially simple, holderless embodiment provides for a direct mounting of the valve stem in the enclosing element, in that an upper end is formed in a cranked or T-shape and is inserted in at least one bearing sleeve, connected to the enclosing element, or insertion opening configured there. The sliding surfaces can be provided in the upper part of the valve stem, which can also there be thickened, for example.

If the sliding surfaces are configured at the upper end of the valve stem, yet other options are obtained in terms of design particulars. Thus, at the upper end of the valve stem, a bearing eye can be configured, the outer contour of which is provided with the sliding surfaces and in which the hinge pin of the holder engages, which hinge pin, in this embodiment, can be fixedly connected to the enclosing element.

For the mounting of this valve drive in the cylinder head, the lower end of the valve stem is preferably provided with a thread and screwed into the valve disk. The valve drive can therefore be inserted into the cylinder head from above, the valve preferably being set to maximum opening, whereupon the valve disk is fixed. The parts of the valve can therefore also consist of different materials, for example of ceramic, steel, etc. The thread can here also have the function of an expansion bolt. Depending on the arrangement and configuration of the inlet or outlet duct, it is also herein conceivable for the valve disk to extend obliquely to the valve stem. If the camshaft is built out of individual elements, the cylinder head can also be configured in one piece and have bush-type bearing openings.

Despite the forced guidance through the enclosing element, the valve, too, can assume a slant and, in at least one principal direction, deviate from the right angle to the rotation axis of the shaft if the valve stem is arranged such that it is displaceable, relative to the cam element, parallel to the shaft. This is possible if the hinge pin can slide either in the bearing sleeve of the enclosing element or in the bearing eye of the valve stem. The displacement travel depends on the slant of the valve stem and generally amounts to just a few millimeters.

In a further preferred embodiment, two valves can be actuated jointly. For this purpose, it is envisaged, for example, that the cam element is provided on both sides with a holder for a valve guided at the upper end next to the cam element. In a second embodiment, the two valves can be disposed between two equidirectional cam elements, the two holders having a common hinge pin disposed in both enclosing elements.

An arrangement in which the axis of the valve stem of the parallel-running axial plane of the shaft is laterally offset is also possible as a result of the guide of the valve stem, which guide is drawn right up into the holding region, in which embodiment altered opening and closing characteristics of the valve are obtained.

The lateral arrangement of the valve stems next to the cam elements and their guide, drawn up practically as far as the carrier shaft, can give rise, as already mentioned, to especially low cylinder heads, this lateral arrangement likewise promoting the guidance of the inlet and outlet ducts. The duct can in fact be guided next to the relatively large bearing recess, necessary in the cylinder head, for the cam element, in which case, in combination with a corresponding slant, cross-sectional configuration and valve seat configuration, for example appropriate to the oblique valve disk, the cylinder head height can be so far reduced that, even though its basic measure is dependent, in turn, on the minimum guide length of the valve stem, this guide length lies substantially closer to the driven shaft and is preferably also divided into two mutually spaced portions. Especially in the embodiment in which the two valves are provided on a common hinge pin between two cam elements, the valves can be distanced sufficiently far away from the cam elements that a problem-free arrangement of the ducts is possible. The hinge pin can in this case also be cranked in the style of a stirrup, so that its middle portion runs closer to the shaft.

A first preferred embodiment of a cylinder head has a semicircular bearing recess for the shaft and a semicircular bearing recess for each cam element, in the region of a bore for the reception of the valve stem guide surfaces being provided for that end of the valve stem which is connected to the enclosing element, which guide surfaces extend in the direction of displacement of the valve. In particular, a guide sleeve made from an appropriate bearing material and whose upper end has a slot is pressed into each bore of the cylinder head, the guide surfaces being provided in the region of the slot. The slot serves the passage of the hinge pin to the connecting point with the enclosing element, which connecting point lies alongside the guide sleeve. The guide surfaces can also be provided on rollers, rolling elements or the like.

In a second, particularly material-saving embodiment of the cylinder head, it is envisaged that it has a base element having a bearing web for the shaft and having a guide web for the valve, which guide web is disposed in the region of the bore for the reception of the valve stem, the guide web being assigned guide surfaces for that end of the valve stem which is connected to the enclosing element. If the cam element has a groove, the guide web can be configured in two parts in extension of the groove and the thickness of the two parts of the guide web corresponds maximally to the width of the groove.

BRIEF DESCRIPTION OF THE DRAWINGS

The invention is described in greater detail below with reference to the figures of the appended drawings, without being restricted thereto.

FIG. 35 represents a cross section and FIG. 36 a front view of the holding region, respectively in a part-opened valve setting. Further, FIG. 37 shows a cross section, FIG. 38 a longitudinal section and FIG. 39 an oblique view through the cylinder head, and FIG. 40 a section through the holding region, respectively in valve-open setting;

DESCRIPTION OF THE PREFERRED EMBODIMENTS

Figure 1:
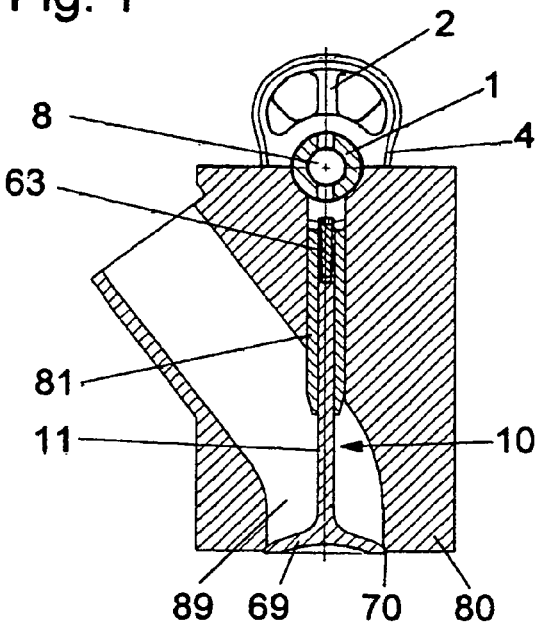
FIGS. 1 to 3 show a first embodiment of a cylinder head having a valve drive comprising at least one valve, FIG. 1 showing a section perpendicular to the driven shaft, FIG. 2 a longitudinal section and FIG. 3 the detail A from FIG. 2 in enlarged representation.

A valve drive comprises, in all embodiments, a driven carrier shaft 1, on which at least one cam element 2 is fixed in a manner which is not described in greater detail. The cam element 2 is surrounded by an enclosing element 4, which consists especially of high-tensile, low-friction fibers, such as Kevlar, aramid, glass or carbon fibers, which, for example, are made up into a fabric produced in a textile circular-working method or, through helical winding, are made up into a closed loop, of a high-tensile plastics or metal band, or the like. The enclosing element 4 has a holding region 6 having a insertion opening 7, in which holding region it is hinge-connected to a valve 10 by a holder 12. As a result, the enclosing element 4 cannot rotate jointly with the cam element 2, but can translate the latter's rotary motion into an oscillating motion which imparts an opening and closing motion to the valve 10 disposed in a slideway. The valve disk 69 thereby lifts off from the valve seat 70, or closes it, so that the inlet or outlet duct 89 in the cylinder head 20, 80 is opened or reclosed. The cam element 2 can have a radial bore 3, via which, from the hollow shaft 1, oil can be introduced into the region between the cam element 2 and the enclosing element 4.

The enclosing element 4 is connected to the valve stem 11 of the valve in several different ways, which are described in greater detail below. The valve stem 11 is guided in the cylinder head 20, 80 through a bore 88, in which is inserted a guide sleeve 81, the lower region of which is closed and the upper end region of which is provided with a slot 82. In the embodiments according to FIGS. 1 to 16, the cylinder head 80 has a semicircular bearing recess 91 for the shaft 1 and a semicircular bearing recess 86 for each cam element 2, which latter bearing recess is provided with a central indentation 92 to create room for the connection between the enclosing element 4 and the holder 12. The bore 88 emerges upward into the bearing recess 91 for the shaft 1 and opens laterally into the bearing recess 86 for the cam element 2. The inner sides of the slotted region of the inserted guide sleeve 81 form guide surfaces 85 for the holder 12 of the valve stem 11 or its upper end, which guide surfaces ascend almost up to the shaft 1. The high-drawn guide allows the height of the cylinder head 80 to be considerably reduced without having to dispense with the necessary characteristics (good heat dissipation, high power take-up, etc.).

In the embodiments according to FIGS. 17 to 49, the cylinder head 80 is reduced in weight and comprises a base plate 20, from which at least one bearing web 21 rises up, in which the shaft 1 is mounted. At least one guide web 22 rises up, laterally offset, in the region of the bore 88 for each valve 10, on which guide web the guide surfaces 85 are directly configured or in which guide web a guide sleeve 81 having the guide surfaces 85 and the slot 82 is inserted. The bearing web 21 and the guide web 22 can be screw-connected, plug-connected or otherwise connected to the cylinder head 20, 80; they can also, however, be configured in one piece with the cylinder head 20, 80.

In the embodiments according to FIGS. 1 to 24, the holder 12 projects laterally over the cam element 2, and the valve 10 and high-drawn guide lie respectively alongside the cam element 2.

In the embodiments according to FIGS. 25 to 49, the usual arrangement, on the other hand, is maintained, i.e. the holder 12 does not lie offset within the envelope of the rotary cam element. In these embodiments, the cam element 2 has a central peripheral groove 31, which is provided in extension of the guide web 22. In the axial direction of the shaft 1, the guide web 22 is no wider than the peripheral groove 31, so that, when the cam element 2 rotates, the guide web 22 can penetrate into the cam element 2. The enclosing element 4 has in the holding region 6 a slot 5, which leaves the groove 31 uncovered and extends approximately over half of the periphery of the enclosing element 4.

Figure 2:
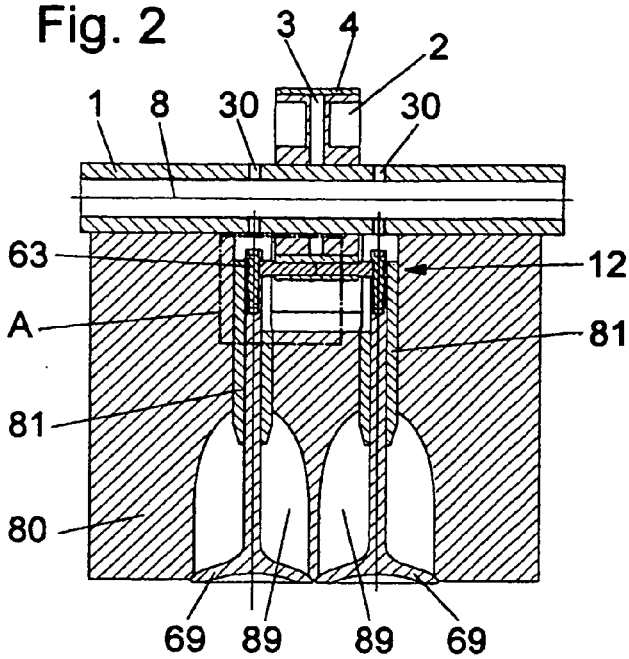
Figure 3:
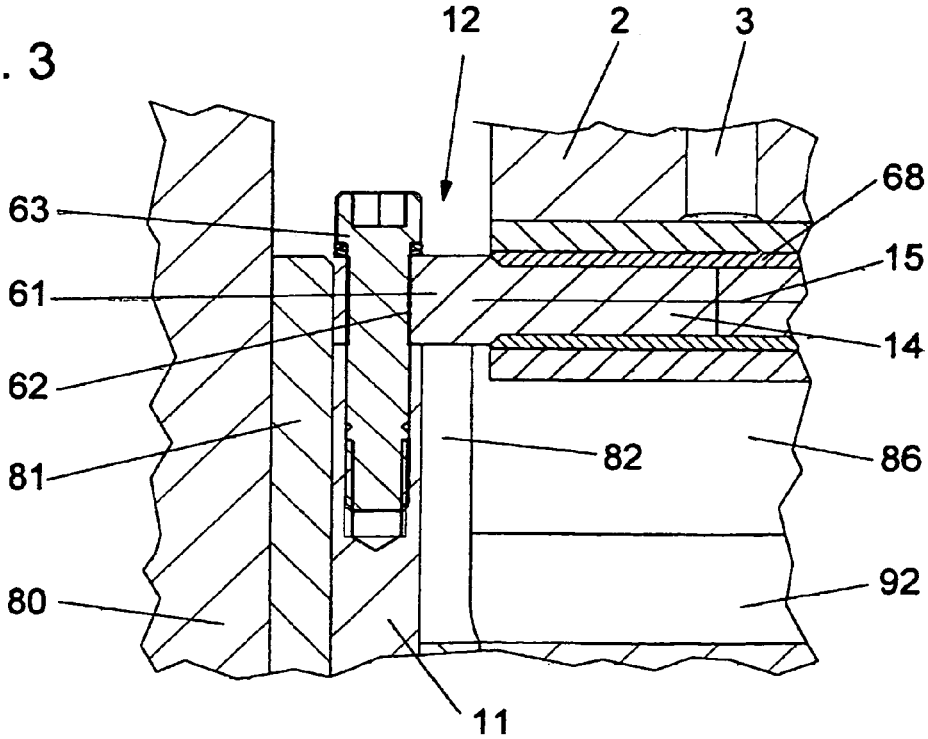

In the embodiment according to FIGS. 1 to 3, the insertion opening 7 of the enclosing element 4 is provided with a bearing sleeve 68, in which, from both sides, a hinge pin 14 of a holder 12 is rotatably inserted. That region 61 of the holder 12 which projects axially over the cam element 2 is provided with a bore 62. The upper end of the valve stem 11 has a threaded bore, in which is inserted a fastening screw 63 which passes through the bore 62 and fixes the valve 10 on the holder 12. In order to facilitate access to the screw 63, the above-lying shaft 1 contains a bore 30 through which a tool can access the screw 63. The hinge pin 14 in this case passes through the slot 82 of the guide sleeve 81, the outer face of the region 61 bearing the bore 62 and that portion of the hinge pin 14 which is guided in the slot 82 forming sliding surfaces 65 of the holder 12, which slide up and down on the guide surfaces 85 of the guide sleeve 81.

Figure 4:
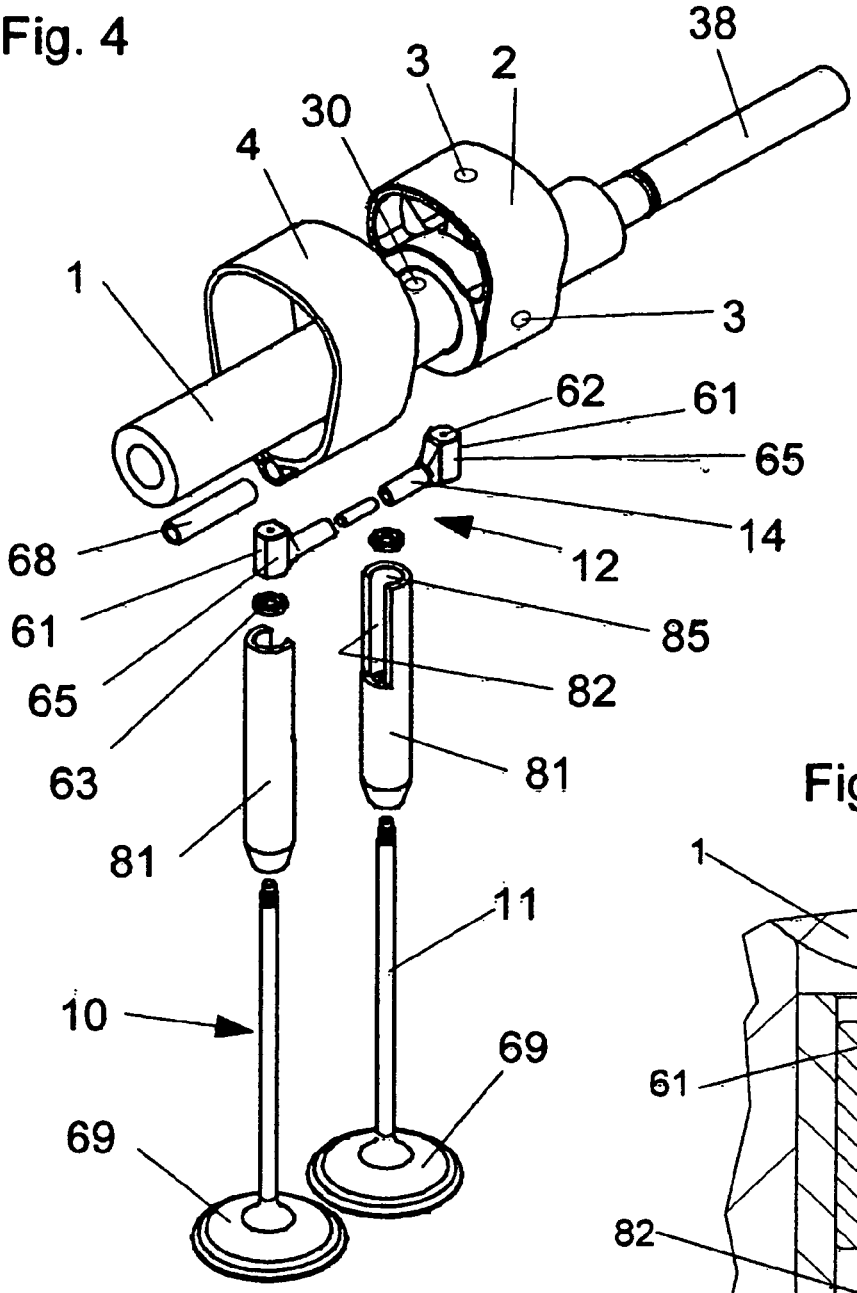
FIGS. 4 to 7 show a second embodiment of a cylinder head having a valve drive comprising at least one valve, FIG. 4 showing an exploded representation in oblique view, FIG. 5 a longitudinal section, FIG. 6 the detail A of FIG. 5 in enlarged representation and FIG. 7 an enlarged section along the line VII—VII of FIG. 5.
Figure 7:
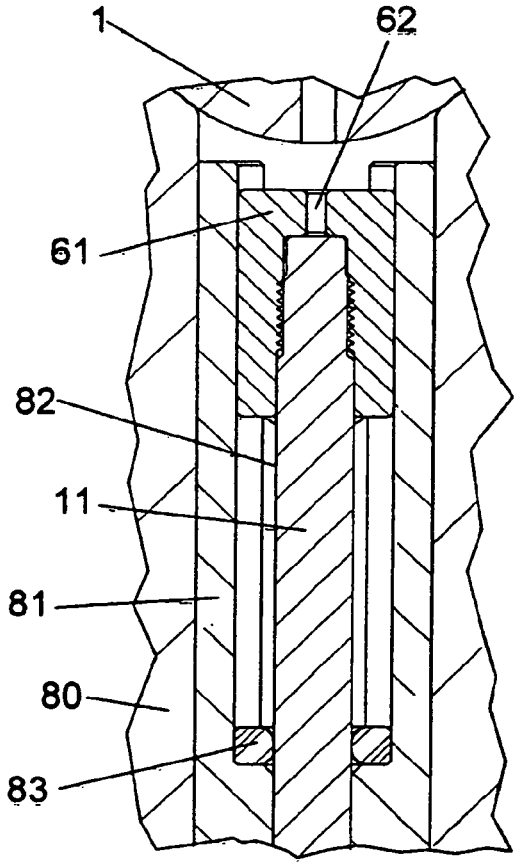
Figure 5:
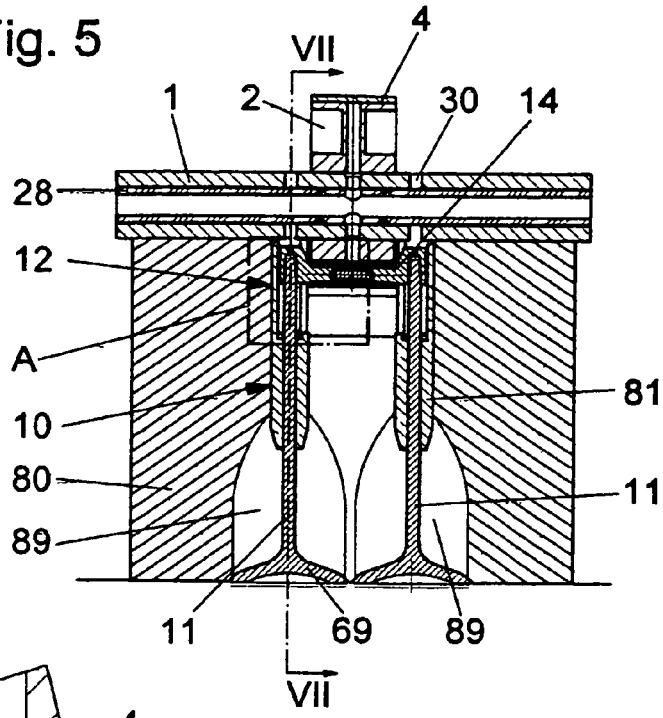
Figure 6:
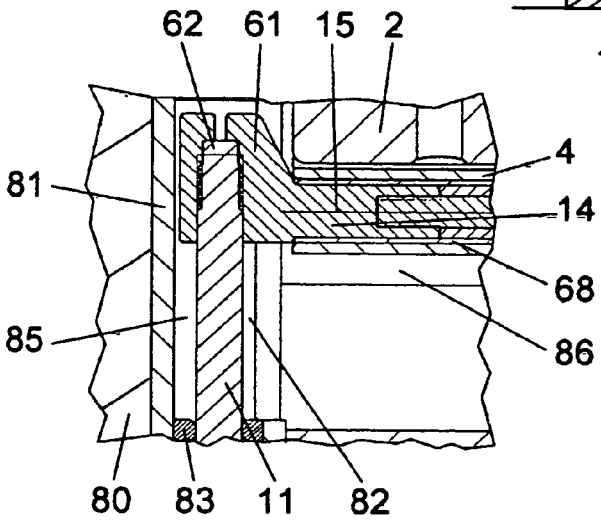

In the very similar embodiment according to FIGS. 4 to 7, the holder 12 is provided, in turn, with a hinge pin 14, which is rotatably mounted in a bearing sleeve 68 and the axially projecting region 61 of which has a threaded bore and sliding surfaces 65. The projecting region 61 is mounted displaceably in the guide sleeve 81, the hinge pin 14 being guided outward through the slot 82. The upper end of the valve stem 11 is provided with a thread and screwed into the bore 62 of the holder 12. Here, too, an adjustment of the valve stem and the placement of a fixing counter-screw, via a bore 30, in the above-running shaft 1 is possible. FIGS. 4 and 5 also show a core barrel 38 (not shown in the embodiment according to FIGS. 1 to 3), which, following mounting of the valve drive, is pushed into the shaft 1 and covers the bore 30 from inside. From the enlarged representations of FIGS. 6 and 7, the guide for the valve stem 11, which guide approaches close to the shaft 1, can be especially well seen. The guide is divided into two mutually distanced regions, between which there is disposed a seal 83 for the valve seat 11.

Figure 10:
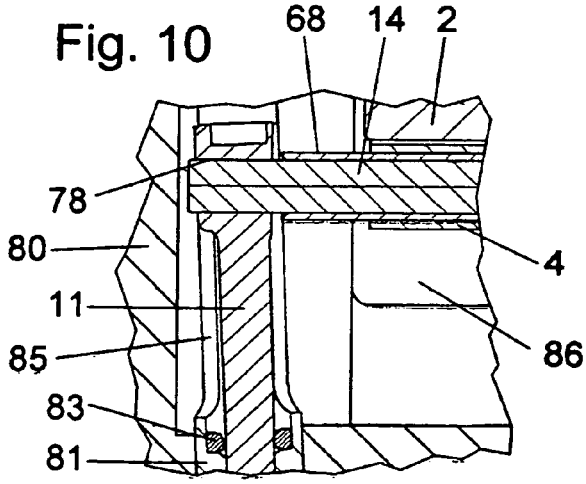
FIGS. 8 to 10 show a third embodiment of a cylinder head having a valve drive comprising at least one valve, FIG. 8 showing an exploded representation in oblique view, FIG. 9 a longitudinal section and FIG. 10 the detail A of FIG. 9 in enlarged representation.
Figure 8:
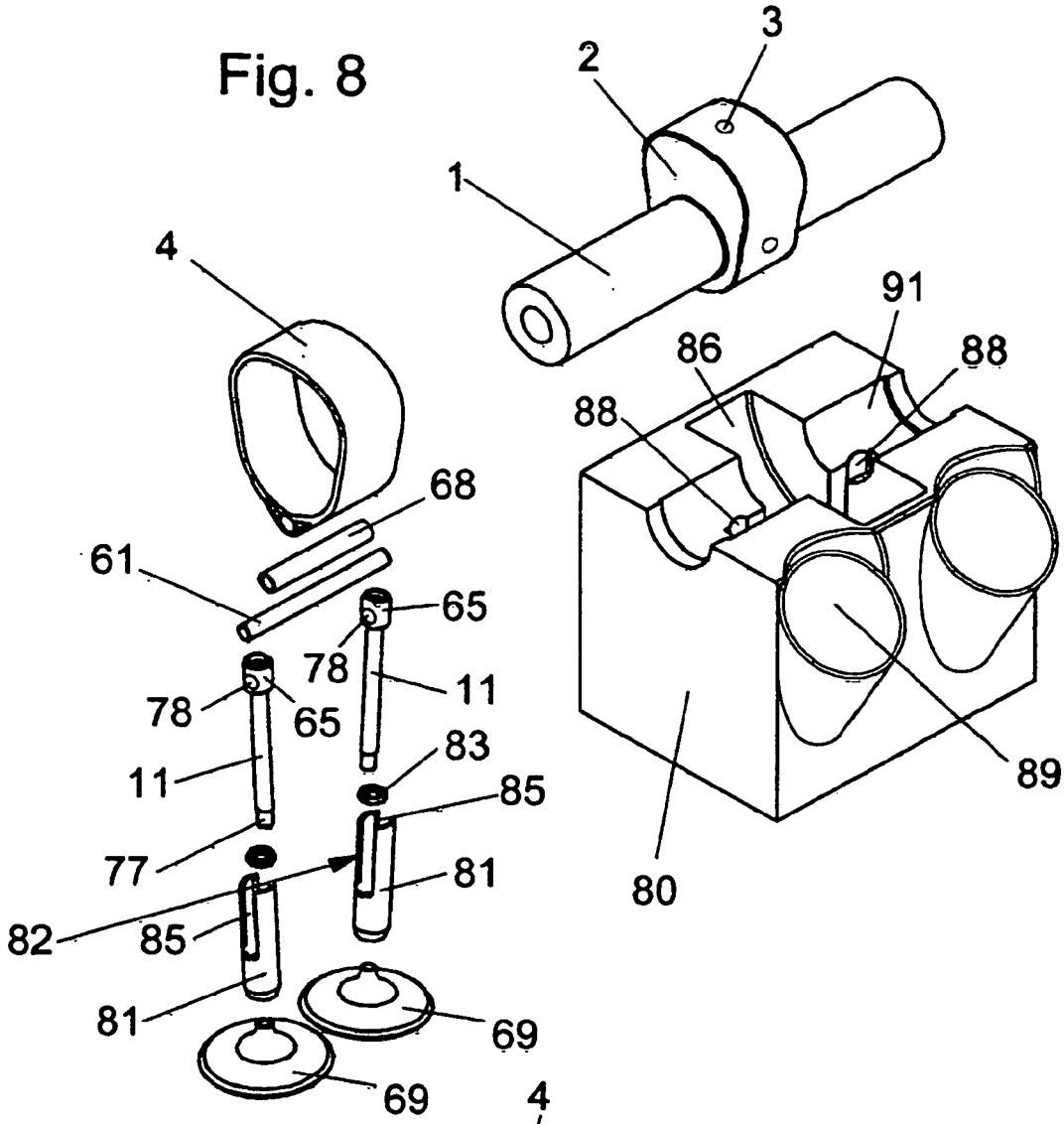
Figure 9:
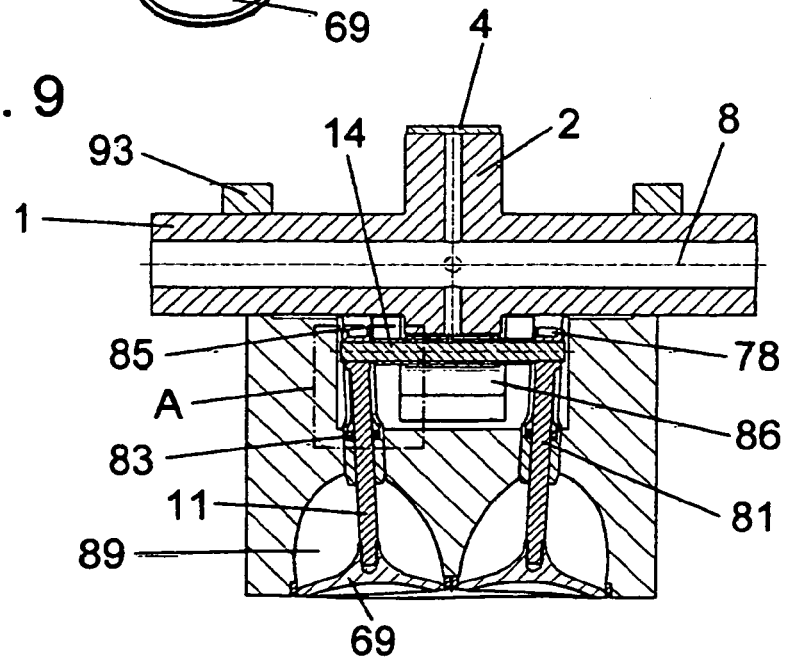

In the embodiment according to FIGS. 8 to 10, the valves 10 are arranged at an inclination relative to the right angle to the rotation axis 8 of the shaft. The bearing sleeve 68 of the enclosing element 4 is passed through by a hinge pin 14, which has regions 61 which project axially on both sides and engage in a respective bearing eye 78, which bearing eyes are configured at the upper ends of two valve stems 11 and are provided with the sliding surfaces 65. The bearing eyes 78 allow the slanting of the valve stems 11, which, upon the lifting motion, move slightly to and fro on the hinge pin 14. The valve stems 11 are provided on the lower ends with a threaded portion, which is screwed into the corresponding threaded bore of the valve disk 69. The hinge pin 14 is again guided in the slots 82 of the two guide sleeves 81.

Figure 11:
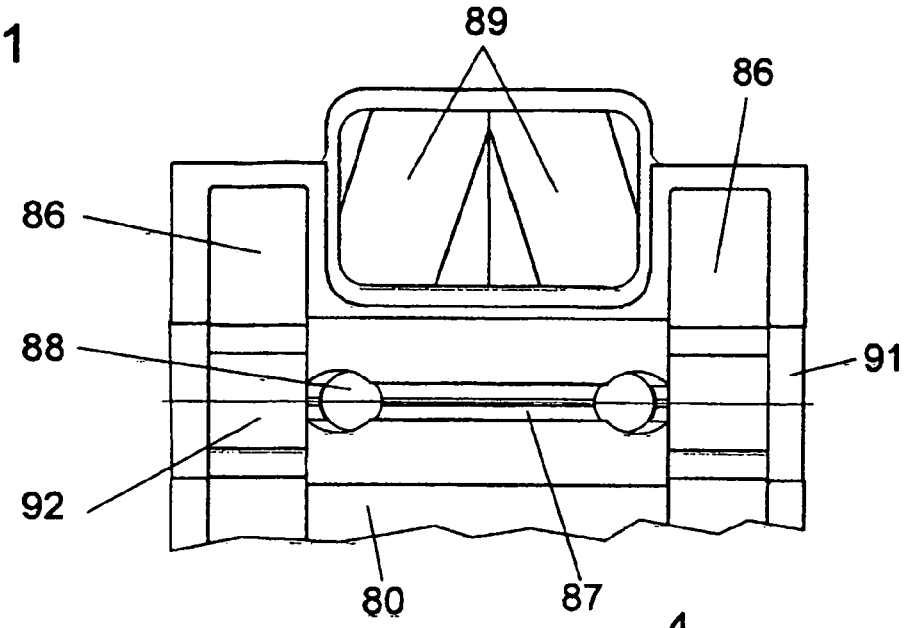
FIGS. 11 to 13 show a fourth embodiment of a cylinder head having a valve drive comprising at least one valve, FIG. 11 showing a top view of the empty cylinder block, FIG. 12 a longitudinal section and FIG. 13 the detail A of FIG. 12 in enlarged representation.
Figure 12:
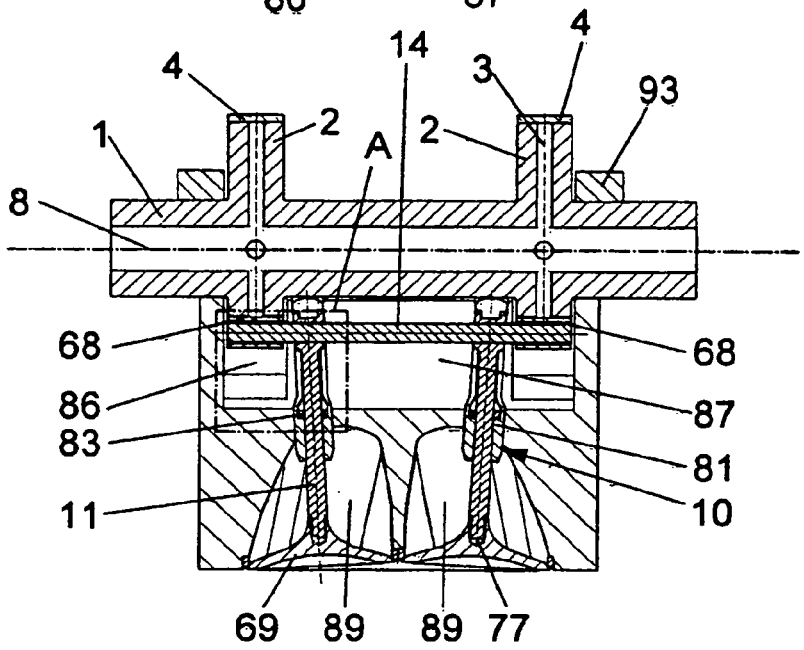
Figure 13:
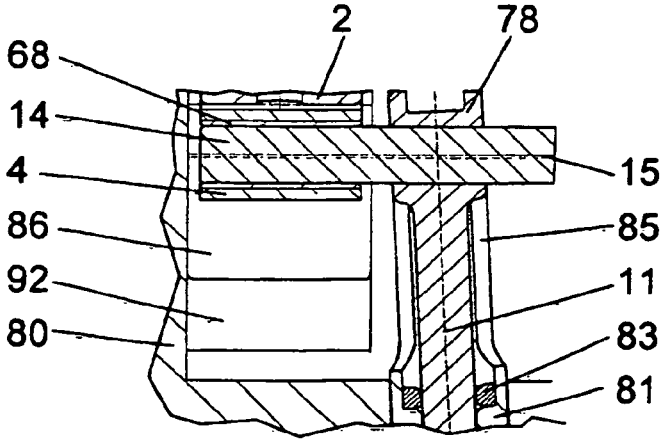

In the embodiment according to FIGS. 11 to 13, the two valves 10 are disposed on a hinge pin 14 connecting two equidirectional cam elements 2 and are inserted in a respective bearing sleeve 68 of an enclosing element 4. The two valve stems 11 are slightly inclined, so that the ducts 89 can be guided in the region between the cam elements 2, as is clearly evident from the top view of FIG. 11. The two bearing recesses 86 for the cam elements 2, inclusive of their central indentations 92 for the connecting regions, containing the bearing sleeves 68, between the enclosing elements 4 and the hinge pin 14 are connected by a central slot 87, in which the up-and-down moving hinge pin 14 is guided. The middle region of the latter can further be cranked in the style of a stirrup, so that it is proximate to the shaft 1, whereby the middle region of the slot 87 can be less deep. Emerging into the slot 87 are the two oblique bores 88, in which are inserted the guide sleeves 81 which, in the upper regions, are slotted for the passage of the hinge pin 14. The bearing eyes 78 have the sliding surfaces 65, which slide on the inner guide surfaces 85 of the guide sleeves 81. As a result of the oblique inclination of the valve stems 11, the bearing eyes 78 move slightly left and right.

Figure 14:
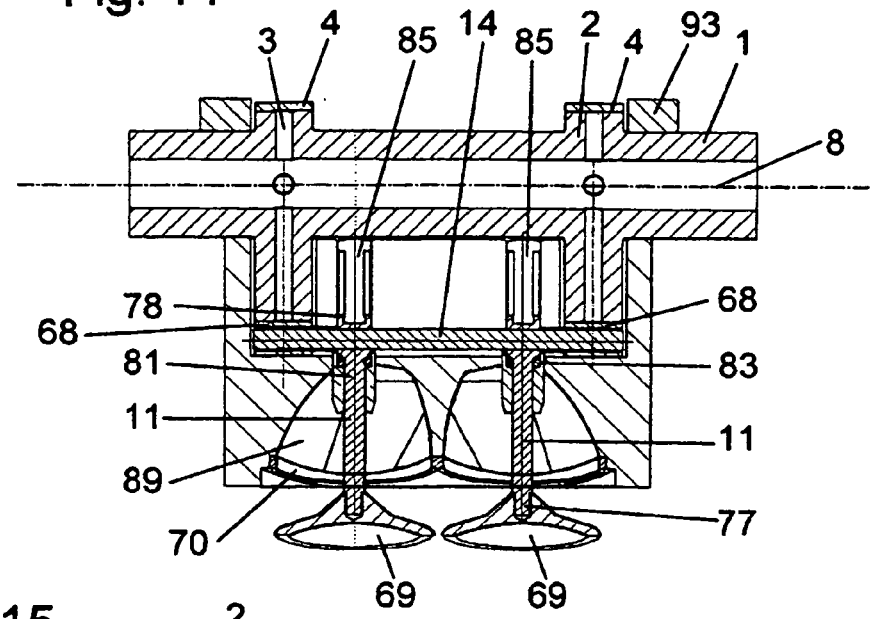
FIGS. 14 to 16 show a fifth embodiment of a cylinder head having a valve drive comprising at least one valve, FIG. 14 showing a longitudinal section, FIG. 15 a section perpendicular to the shaft and FIG. 16 a cut oblique view.
Figure 15:
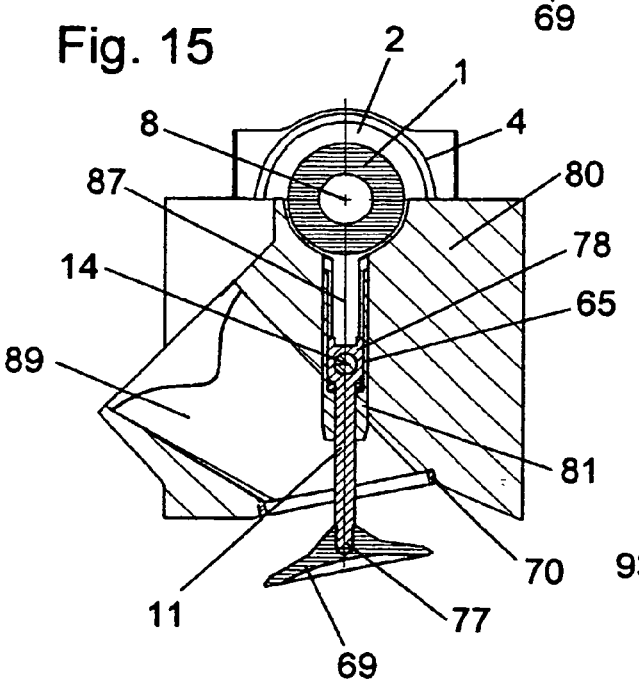
Figure 16:
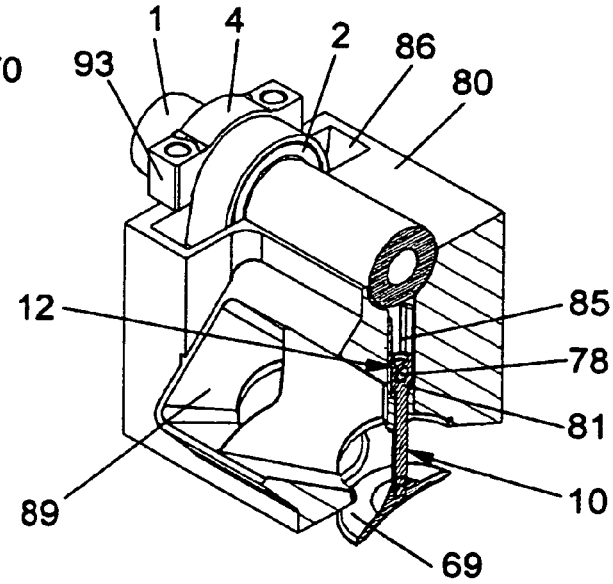
Figure 18:
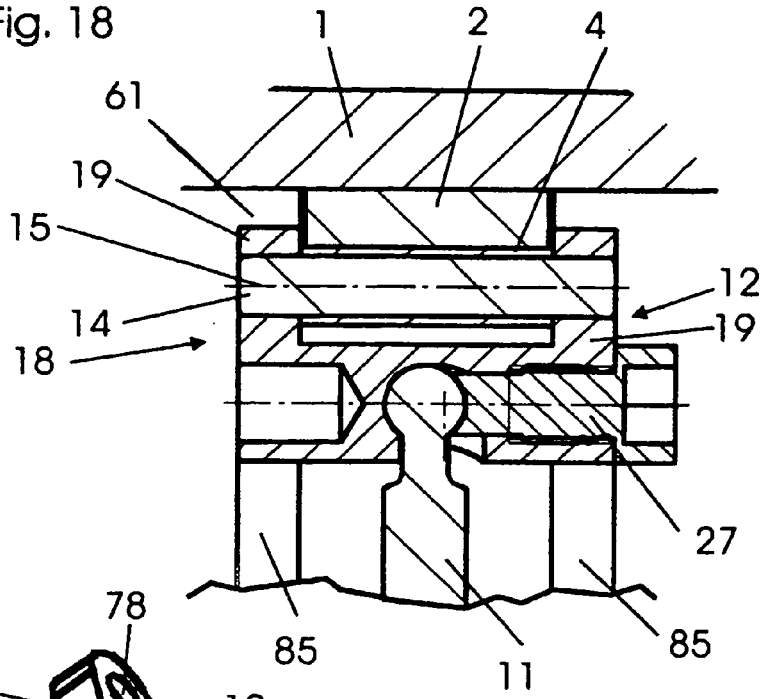
FIGS. 17 to 20 show details of a sixth embodiment of a cylinder head having a valve drive comprising at least one valve, FIG. 17 showing an oblique view of a holder, FIG. 18 a section through the holding region, FIG. 19 an oblique view of the guided holding region and FIG. 20 a side view of the guided side region.
Figure 17:
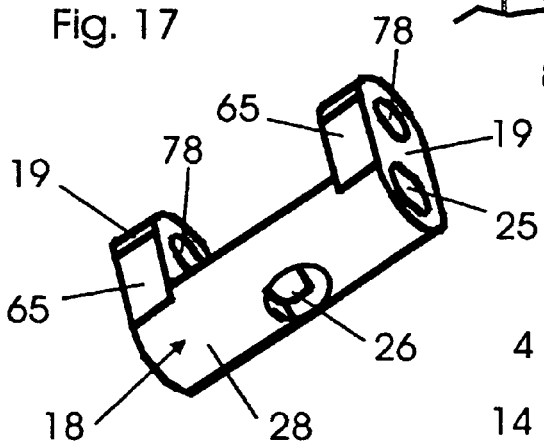
Figure 20:
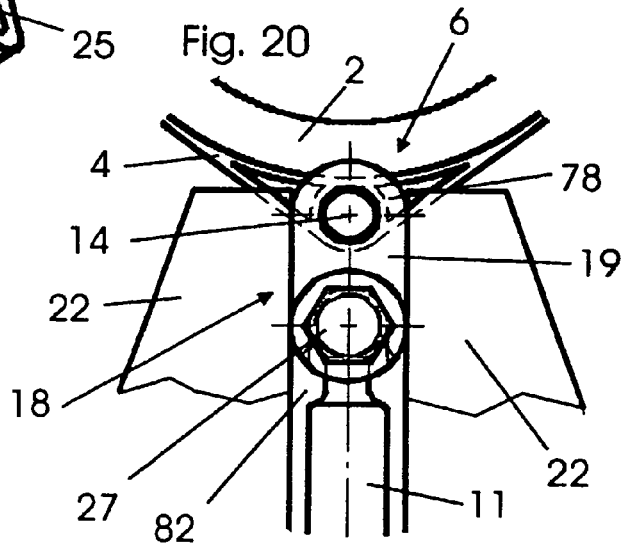
Figure 19:
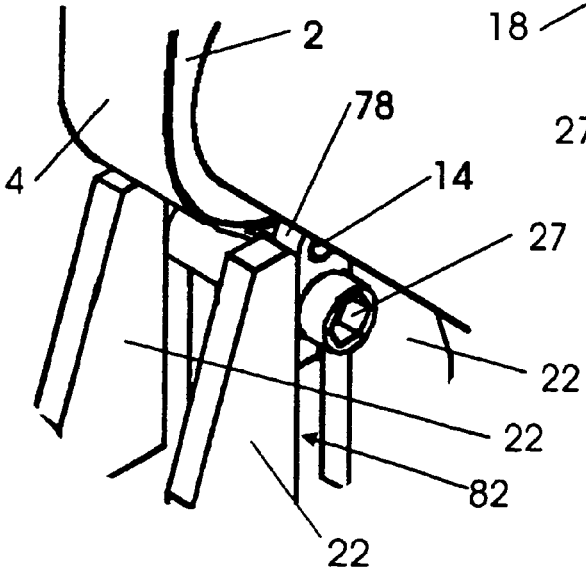
Figure 21:
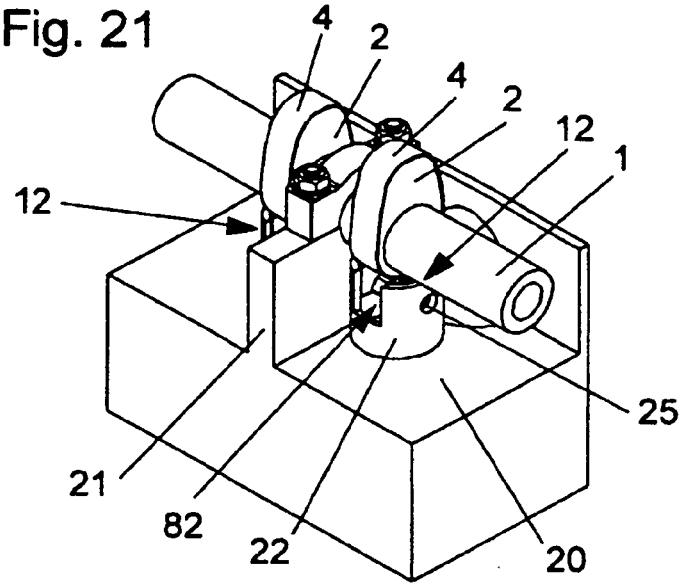
FIGS. 21 to 24 show a seventh embodiment of a cylinder head having a valve drive comprising at least one valve, FIG. 21 showing an oblique view, FIG. 22 a holder in oblique view, FIG. 23 a section through the holding region and FIG. 24 a section through the holding region along the line XXIV of FIG. 23.
Figure 22:
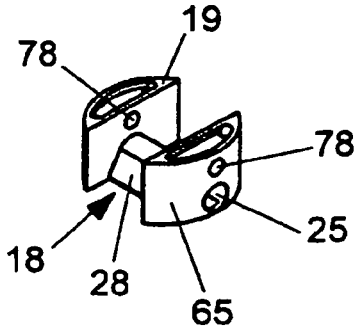
Figure 24:
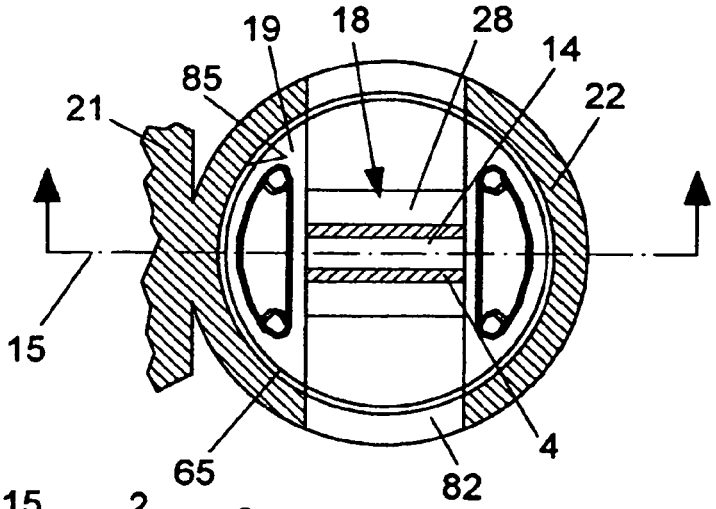

FIGS. 14 to 16 show a similar embodiment, in which the height of the cylinder head 80, despite sufficient guide length for the valves 10, is once again reduced, since, in the ducts 89, diagonal valve seats 70 for the valve disks 69 are configured, which, for their part, are again fastened obliquely to the valve stems 11, for example by the thread 77, but which could equally be replaced by a press-fastening or another kind of fastening. In the oblique view of FIG. 16, the bearing shells 93 for the shaft 1 are also visible, which are mounted on the top side of the cylinder head 80.

In FIGS. 17 to 24, two embodiments are shown, in which only the guide, but not the valve 10, is laterally offset in relation to the cam element 2. According to FIGS. 17 to 20, the holder 21 has a hinge pin 14 which is inserted in the insertion opening 7 of the enclosing element 4 and projects on both sides. In its projecting regions 61, a fork-shaped connecting part 18, provided with two eyes, is pivoted, on which the end of the valve stem 11 is centrally fixed. The connecting part 18 has a blind bore 25, the floor of which is a spherical surface and into which a receiving bore 26 for the upper end of the valve stem 11 emerges, which end, in this embodiment, has an offset spherical head. Inserted in the blind bore 25 is a screw 27, the front side of which likewise has a spherical surface and fixes the spherical head of the valve stem 11. If the screw 27 has an end stop, then the spherical head is held not clamped but rotatably. The lateral members 19 of the fork-shaped connecting part 18, which members are provided with the eyes 78, are provided on the outer side with the sliding surfaces 65, which are guided on the guide surfaces 85. As can be seen from FIG. 19, the guide surfaces 85 are configured on guide webs 22 or inserts made from bearing material, which on both sides of the cam element 2 approach close to the shaft 1.

Figure 23:
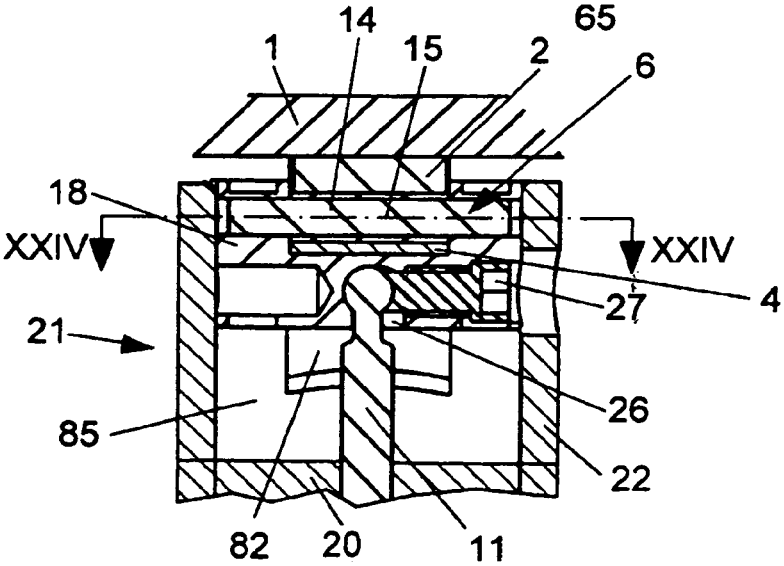

According to FIGS. 21 to 24, the guide webs 22 form cylindrical elements and the connecting part 18 of the holder 12 has a circular outer contour. The lateral members 19 of the connecting part 18, which members are provided with the eyes 78, constitute cylinder segments, which on the outer side have sliding surfaces 65 and are connected by a transverse part 28 and the distance apart of which corresponds to the width of the cam element 2. The connecting part 18 has in its lateral members 19 the two eyes 78, which are mounted rotatably on the hinge pin 14 projecting from the insertion opening 7 of the enclosing element 4 on both sides (FIG. 23). Self-evidently, the hinge pin 14 can also be mounted rotatably in the insertion opening 7, or a bearing sleeve 68 provided there, and can be fixed in the eyes 78. In the transverse part 28 of the holder 18, the blind bores 25 and the bottom-side receiving opening 26 are provided, through which the upper end of the valve stem 11, provided with an offset spherical head, is inserted. A screw 27 inserted in the blind bore 25 holds the valve stem 11. The cylindrical guide web 22 has a slot 82 in the width of the cam element 2, so that the cam region has the necessary passage clearance. The holder 12 connected to the enclosing element 4 is thus guided up and down in the cylindrical guide web 22 in a piston-like manner.

Figure 25:
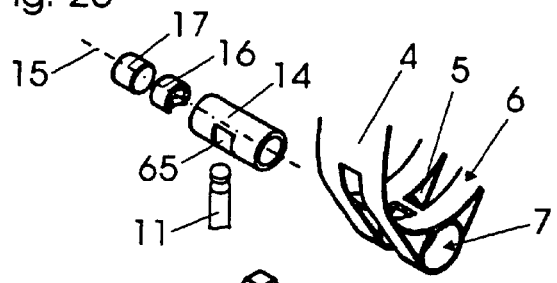
FIGS. 25 to 30 show an eighth embodiment of a cylinder head having a valve drive comprising at least one valve, FIG. 25 showing an exploded representation in oblique view, FIG. 26 a carrier shaft portion having a cam element, FIG. 27 a longitudinal section in oblique view, FIG. 28 the longitudinal section in top view and FIGS. 29 and 30 details of the holding region of a valve in oblique view and in section.
Figure 26:
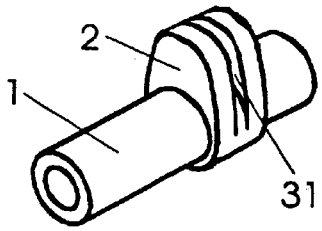
Figure 26:
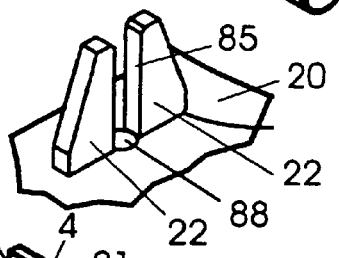
Figure 27:
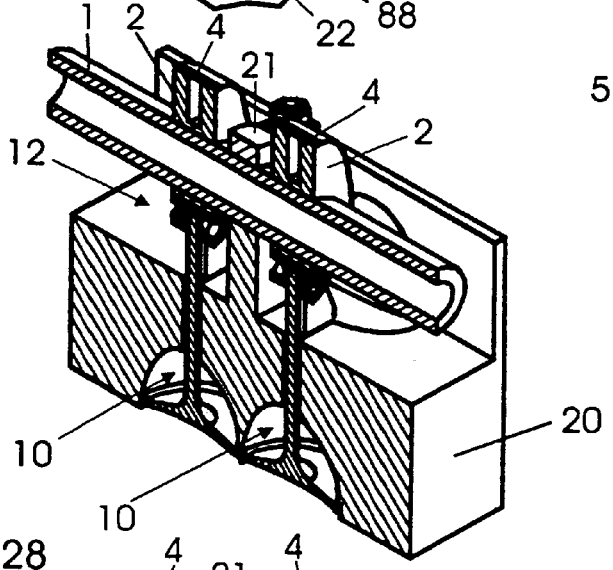
Figure 29:
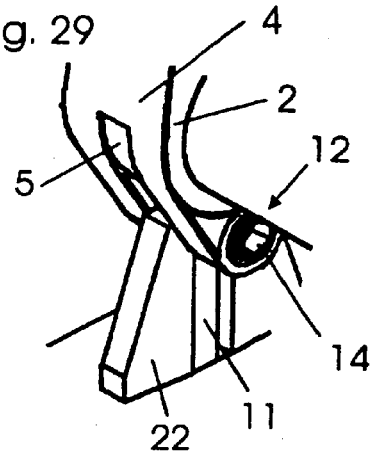
Figure 28:
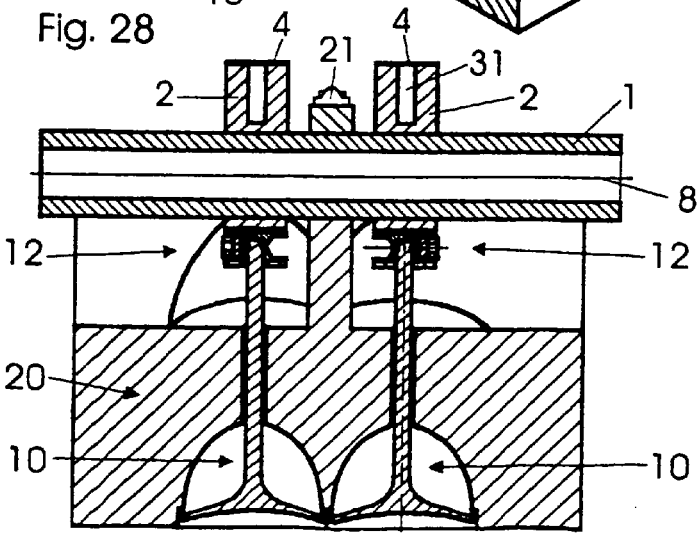
Figure 30:
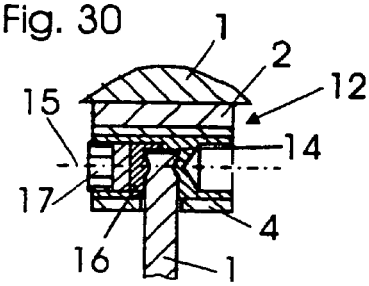

FIGS. 25 to 30 show a first embodiment having a cam element 2 provided with a central groove 31 and having an enclosing element 4 provided in the holding region 6 with a central slot 5. The holder 12 used in this embodiment has a hinge pin 14 inserted in the insertion opening 7 of the enclosing element 4, said insertion opening being provided, where appropriate, with a bearing sleeve 68, which hinge pin is provided with a front-sided blind bore 25 and a therein emerging receiving bore 26 for the upper end of the valve stem 11. The upper end of the valve stem 11 is provided with at least one peripheral channel, in which a rib in the floor of the blind bore 25 and a rib of a fitting piece 16 engage, which fitting piece is held in the blind bore 25 by a screw 17 (FIG. 30). The hinge pin 14 has a flattening on both sides of the receiving bore 26 and the two flattenings form mutually parallel sliding surfaces 65 (FIG. 25). On both sides of the valve stem 11, which is mounted displaceably in the bore 88 of the cylinder head or of the cylinder head base plate 20, a guide web 22 rising up in the bearing recess 86 of the cylinder head 80 or from the base plate 20, extends respectively close to the carrier shaft 1 of the cam element 2, the mutually facing surfaces of the guide webs 22 forming the cylinder-head-fixed guide surfaces 85, on which the sliding surfaces 65 of the hinge pin 14 are guided in sliding motion. The upper regions of the guide webs 22, when the cam element 2 rotates, enter through the slot 5 into the groove 31, which extends at least over the cam region of the cam element 2.

Figure 31:
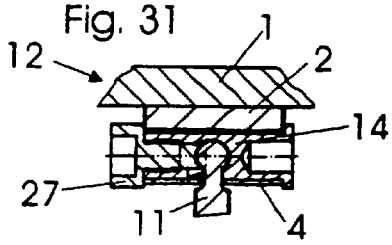
FIG. 31 shows a variant of the holder with a hinge pin.

FIG. 31 shows a variant in which the holder 12, similar to the embodiment according to FIGS. 17 to 20, comprises a hinge pin 14, in which the upper end of the valve stem 11, which end has a spherical head, is held directly by a screw 27. The screw 27 preferably does not clamp the spherical head, but holds it swivel-mounted. The sliding surfaces 65 are formed, in turn, by flattenings of the hinge pin 14.

Figure 32:
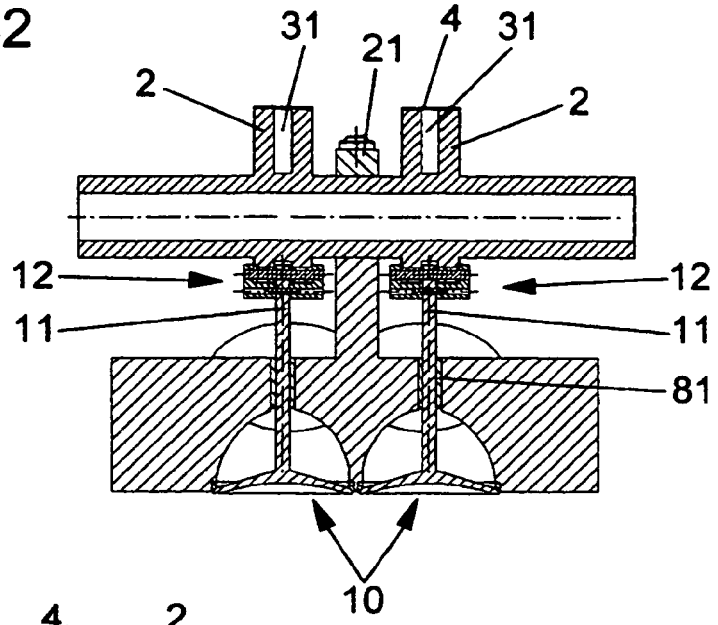
FIGS. 32 to 40 show a ninth embodiment of a cylinder head having a valve drive comprising at least one valve in three different positions during a revolution of the carrier shaft, FIG. 32 showing a longitudinal section and FIG. 33 a cross section through the cylinder head and FIG. 34 an oblique view of the holding region, respectively in the valve-closing setting.
Figure 33:
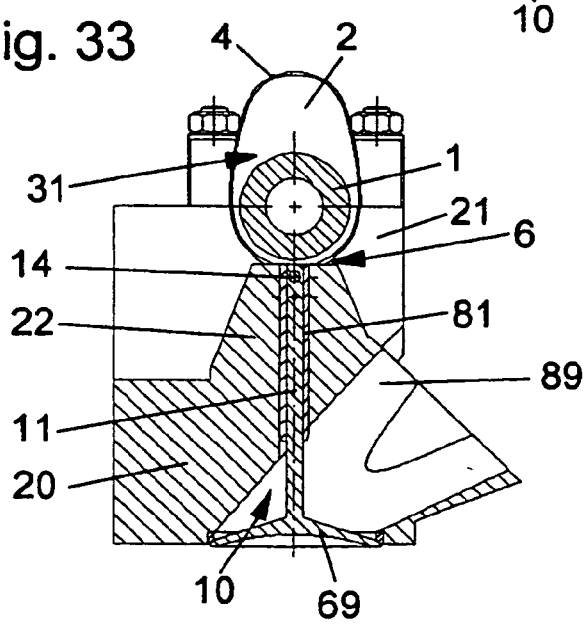
Figure 34:
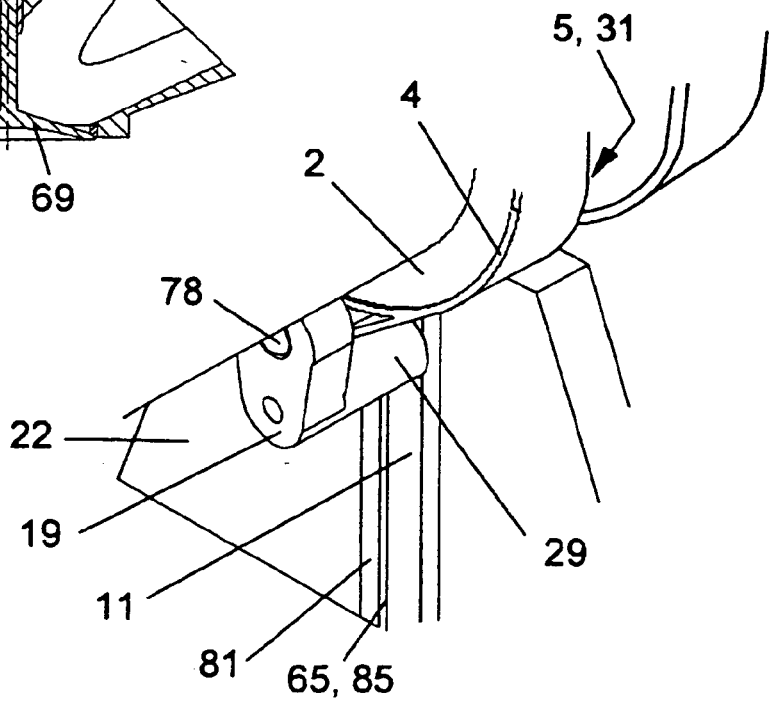

FIGS. 32 to 40 show a further embodiment having grooved cam elements 2, the enclosing elements 4 of which, in turn, have slots 5 in the holding regions 6. This embodiment differs from the previous embodiment by the configuration of a reinforced holder 12. This comprises a connecting part 18 formed from two L-shaped elements, each of which has a side part 19, having an eye 78, and a transverse member 29, having a bore 34. The two L-shaped elements are fixed on the projecting ends of the hinge pin 14. The upper end of the valve stem 11 is provided with two or more mutually parallel bores, the hinge pin 14 being put through the upper bore and the cotter pin 33 being put through the lower bore. This connection is primarily suitable for very thin valve stems 11, which, where appropriate, might be too much weakened by a single bore for the hinge pin 14, or the hinge pin 14 of which has too small a cross section. In this embodiment, three different settings of the valve 10 are shown, which are also similar in the other embodiments. FIGS. 32 to 34 show a basic setting with two valves 10, which close the inlet and outlet ducts 89. The guide webs 22 rising vertically from the cylinder head base plate 20, as can be seen, above all, from FIG. 33, approach close to the carrier shaft 1 of the cam elements 2. The bore for each valve stem 11 is configured within a guide sleeve 81 (FIG. 48), which, in the region inserted in the cylinder head base plate 20, is closed and in the region situated in the guide web 22 has the slot 82, which is passed through by the jutting transverse elements of the holder 12. The width of those wall parts of the guide sleeve 81 which remain on both sides of the slot 82 and on which the guide surfaces 85, rising up almost to the carrier shaft 1, are provided corresponds to the thickness of the guide web 22 and the width of the groove 31, which, in its extension, is configured all the way round in the cam element 2.

As is clearly discernible in the comparison with the oblique view according to FIG. 34, in the section according to FIG. 32 the remaining wall parts of the guide sleeve 81 and the guide web 22 are thus situated exactly behind the valve stem 11 and hence are not, however, fully visible there in the section perpendicular thereto according to FIG. 33.

Figure 35:
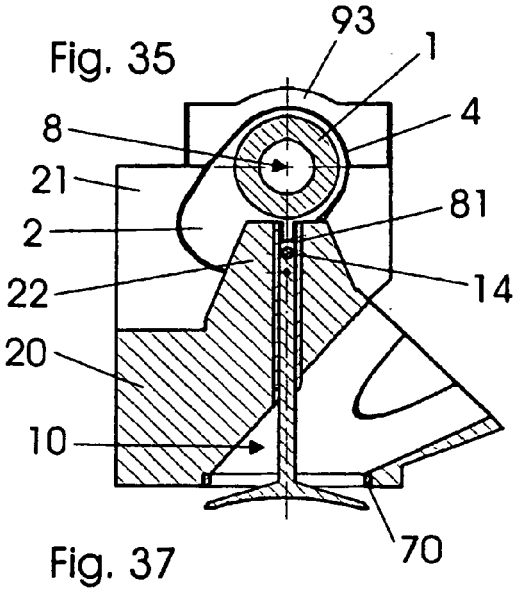
Figure 36:
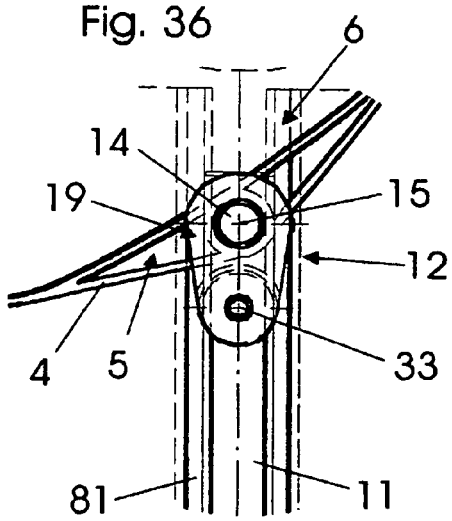
Figure 37:
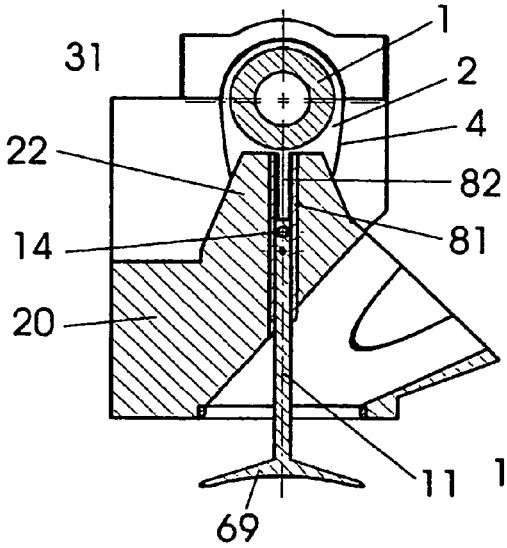
Figure 39:
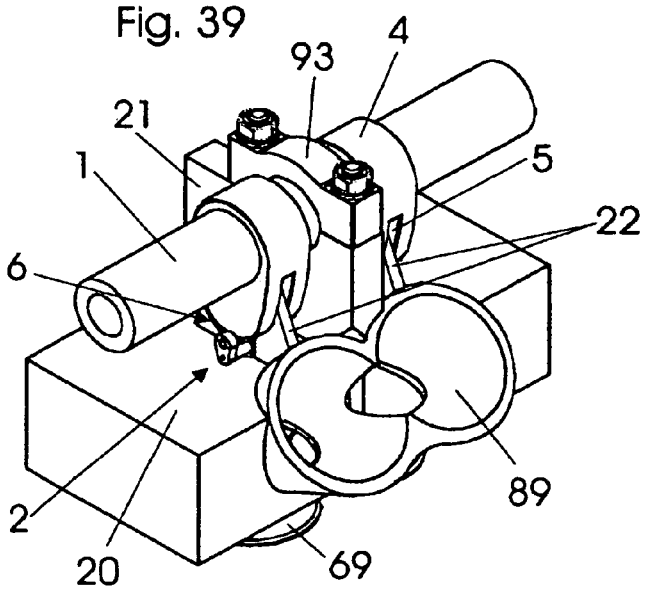
Figure 38:
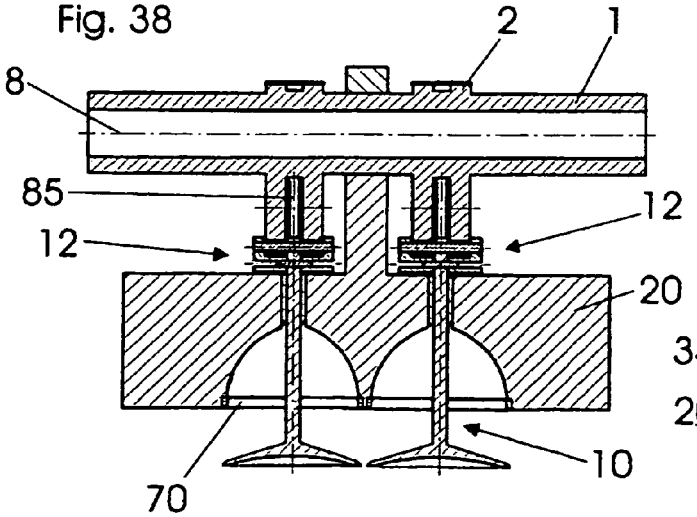
Figure 40:
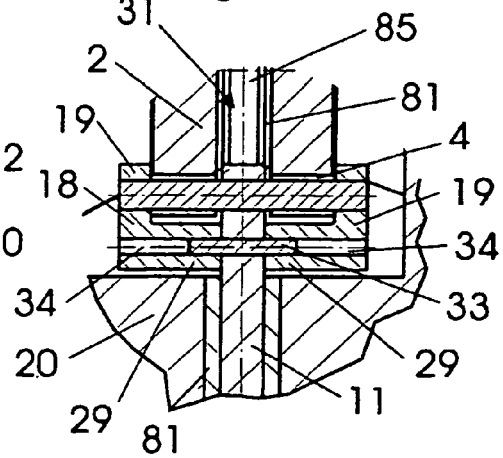
Figure 41:
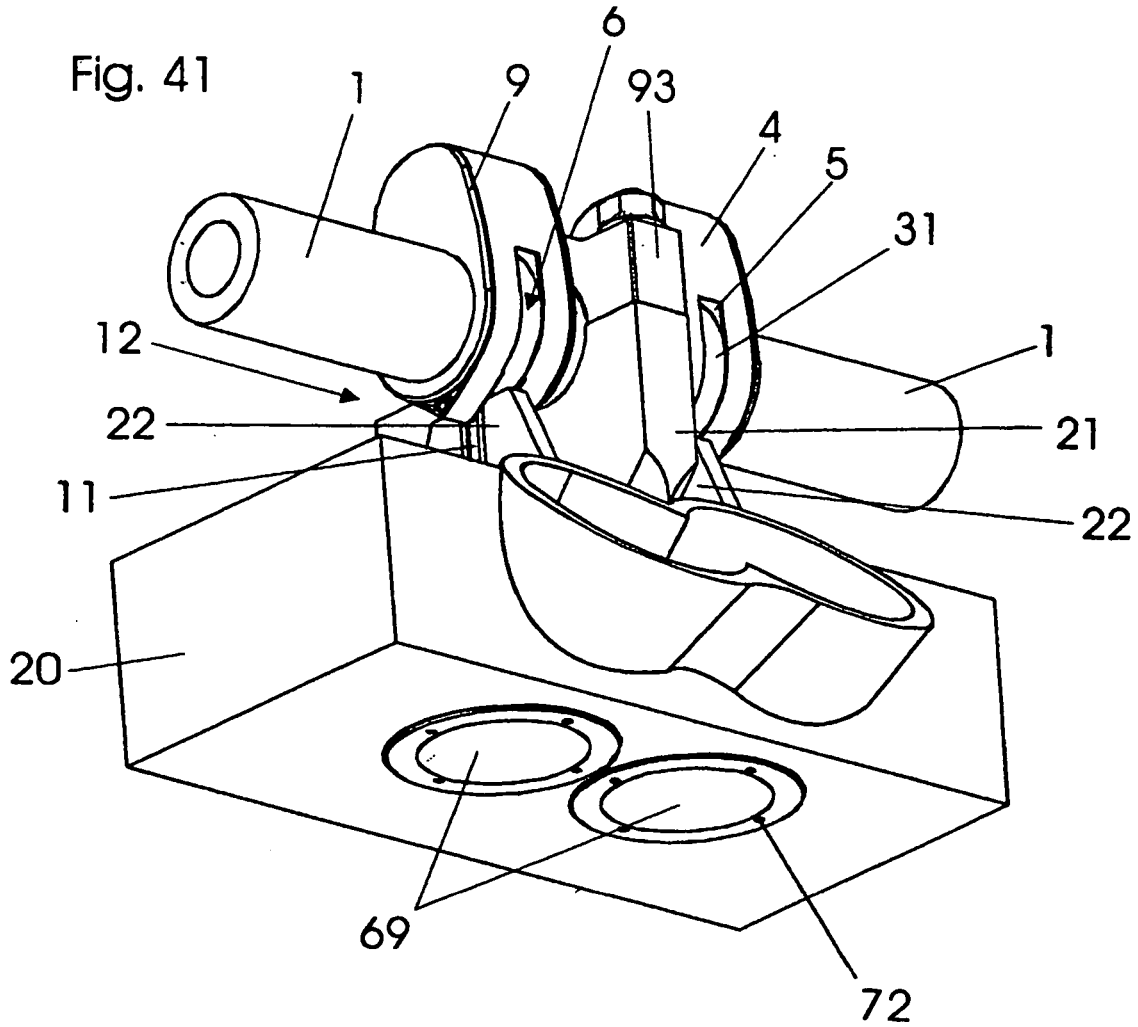
FIGS. 41 to 47 show a tenth embodiment of a cylinder head having a valve drive comprising at least one valve, FIG. 41 showing an oblique view, FIG. 42 a longitudinal section, FIG. 43 the holding region in front view, FIG. 44 the holding region in section, FIG. 45 a carrier shaft portion in oblique view, FIG. 46 a section along the line XLVI of FIG. 42 and FIG. 47 an oblique view of a detail of the guide.
Figure 42:
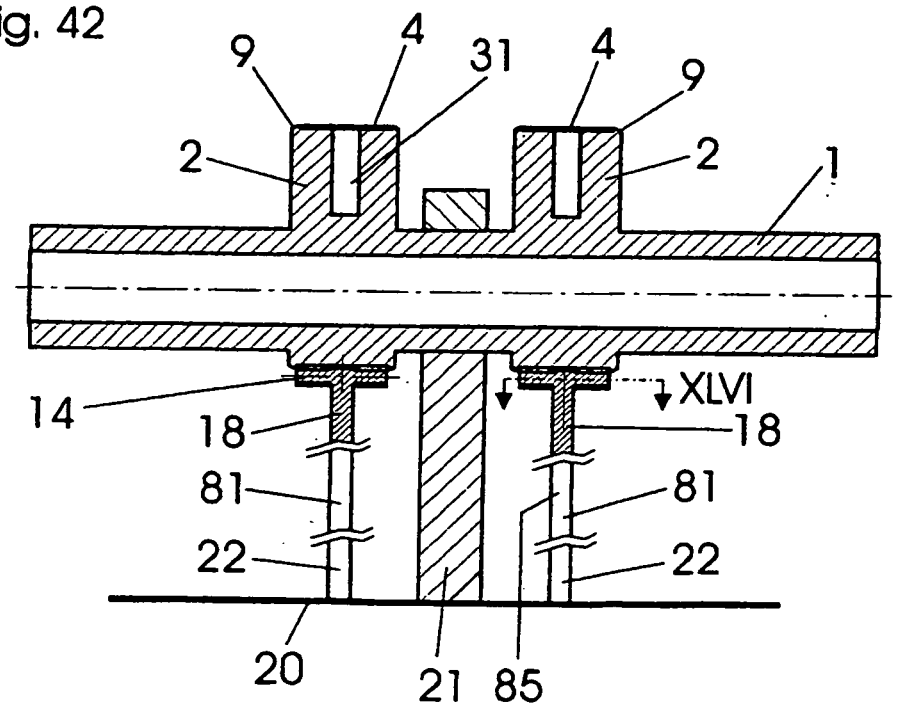
Figure 43:
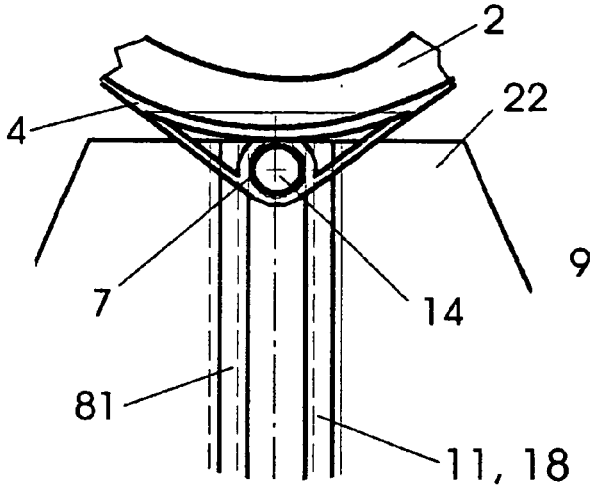

FIGS. 35 and 36 are details of the 120°-twisted setting of the cam element 2, in which cam element the valve disk 69 has been lifted from the valve seat 70. The holder 12 is displaced downward in the guide sleeve 81 and the guide web 22 has entered the groove 31 through the slot 5 present in the holding region 6 of the enclosing element 4, i.e. the two cam regions of the cam element 2 move past on both sides of the guide web. FIG. 36 also shows the twisting of the holder 12 relative to the enclosing element 4 about the axis 15 of the hinge pin 14, since the valve stem 11 does not extend perpendicular to the tangent to the cam element 2, as is the case in the basic setting according to FIG. 33 and in the open setting according to FIG. 37. In the open setting, the holder 12 is pushed downward in the guide sleeve 81 over the full height of the slot 82 and bears almost against the surface of the cylinder head base plate 20. In FIG. 40, the wall part of the guide sleeve 81 with the guide surface 85 is therefore visible in the groove 31 of the cam element 2.

In this embodiment, the sliding surfaces 65 are provided on the valve stem 11, the free ends of the transverse members 29 also, where appropriate, being able to be flattened and guided along the margins of the slot 82 of the guide sleeve 81.

Figure 44:
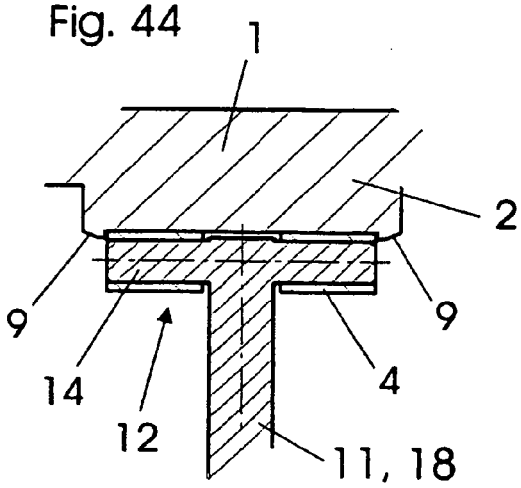
Figure 45:
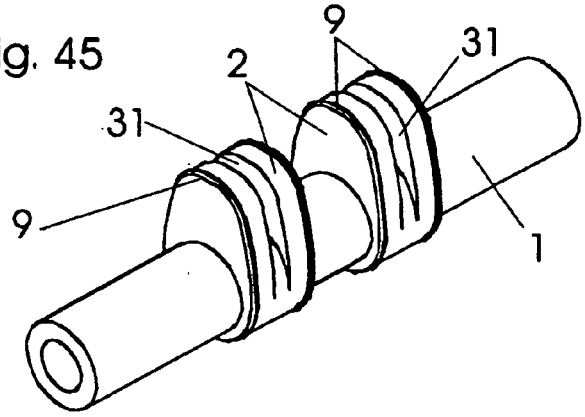
Figure 46:
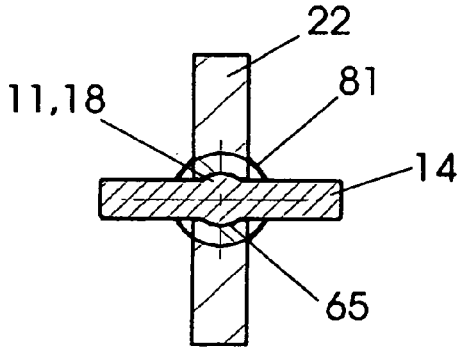
Figure 47:
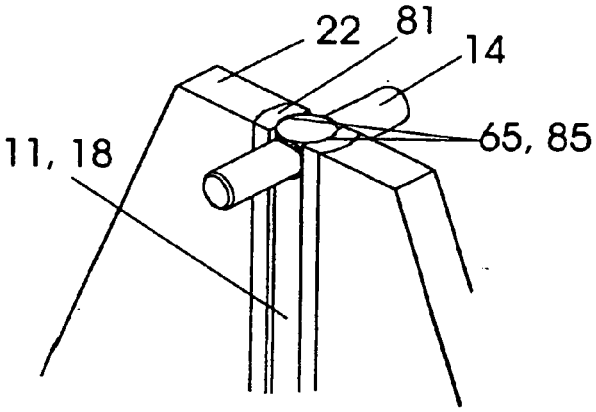
Figure 48:
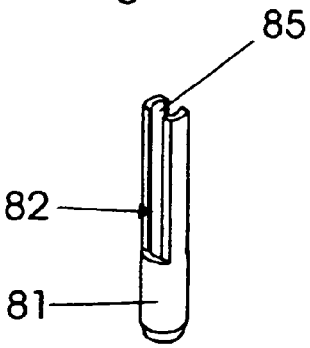
FIG. 48 shows an oblique view of a guide sleeve.

In the embodiment according to FIGS. 41 to 47, a further variant having grooved cam elements 2 is shown, the holder 12 having a T-shape (FIGS. 44, 47), the transverse part of which forms the hinge pin 14 and the central longitudinal part of which either forms the connecting part 18 to the valve stem 11 or the valve stem 11 itself. In the former case, the connecting part 18 is suitably connected to the valve stem 11, for example by a screw connection, if one of the two elements has a thread and the other a threaded bore (similar to FIG. 7). In the second case, the valve stem 11, as in the embodiment according to FIGS. 8 to 16, is provided at the lower end with a thread 77 and screwed into the valve disk 69, which, on the bottom side, can have tool engagement elements 72, for example. As FIG. 44 shows, the two side portions of the hinge pin 14 are inserted in the insertion opening 7 which is divided by the slot 5 in the enclosing element 4 (FIG. 25) and in which, where appropriate, bearing eyes 68 are disposed. The slot 5 is sufficiently large for the two parts of the insertion opening 7 in the enclosing element 4 made of flexible material to be moved so far apart that the hinge pin 14 can be inserted from the slot 5 bilaterally into the insertion opening 7. The further design construction of this embodiment largely corresponds to that of the embodiment according to FIGS. 31 to 40. The sliding surfaces 65 are configured on the valve stem 11 or the connecting part 18, which is guided in the slotted guide sleeve 81 along the guide surfaces 85. The diameter of the hinge pin 14 is less than the diameter of the valve stem 11 or of the connecting part 18, as is evident from the section through the hinge pin 14 shown in FIG. 46. The slot 15 in the enclosing element 4 must exceed in height at least the lift of the valve. Alternatively, it is also possible to extend the slot over the whole of the periphery of the cam element 2, so that the enclosing element 4 is divided into two narrow loops, which are connected by the hinge pin 14 only in the holding region 6. For the axial securement of the enclosing element 4, it is advantageous if the cam element 2 has at the periphery an indentation, laterally delimited by the marginal webs 9, the height of which indentation maximally corresponds to the thickness of the enclosing element 4. In the case of a division into two loops, the margins which delimit the groove 31 are preferably provided with marginal webs 9. In this embodiment, the groove 31 is provided only over the cam region, but, as in the embodiment according to FIGS. 32 to 40, can equally be configured all the way round on the cam element 2.

Figure 49:
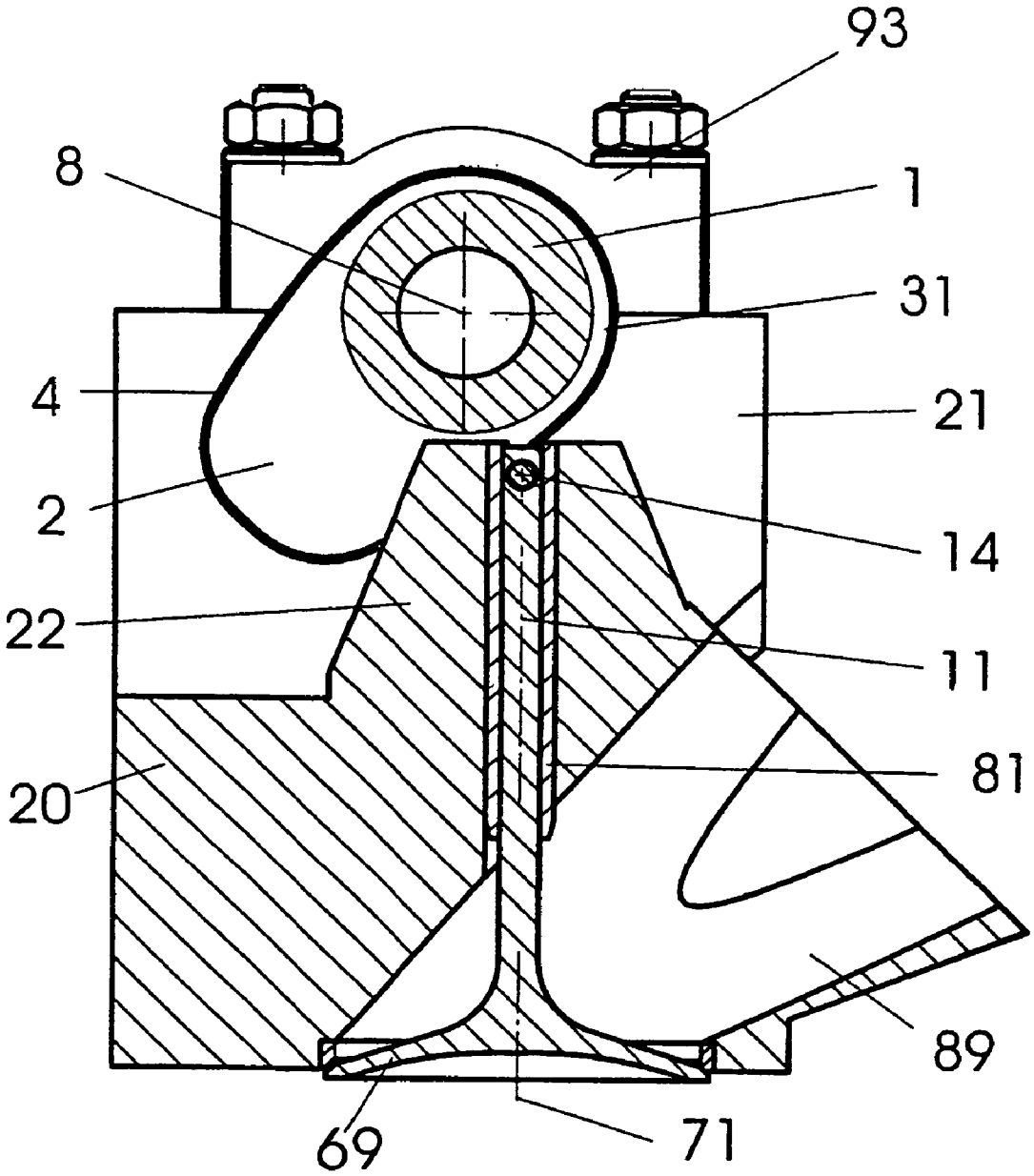
FIG. 49 shows a cross section through an eleventh embodiment of a cylinder head having a valve drive comprising at least one valve.

A further variant is shown in FIG. 49. In this embodiment, the axis 71 of the valve stem 11 does not intersect the axis 8 of the carrier shaft 1, but runs past at a distance therefrom. The valve drive is thus asymmetrical, so that changes in the opening and closing time, as well as in the length of opening, can be obtained by displacement of the rolling and contact lines. The other construction of this embodiment corresponds to that of the embodiments already described above.

The guide web 22 engages in the circumferential groove 31 of the cam element 2 and the valve stem 11 is guided through the guide sleeve 81 into the holding region 6 of the enclosing element 4. The connection of the valve stem 11 and the enclosing element 4 is indicated by the cut hinge pin 14. An asymmetrical arrangement and guidance of the valve is possible in all the embodiments previously described. In addition, it also allows a steeper arrangement of the inlet and outlet ducts 89, if the lateral offsetting of the carrier shaft is effected in the direction shown in FIG. 49, i.e. toward the side facing away from the ducts 89.

I claim:

1. A valve drive, comprising:

at least one cam element disposed on a driven shaft at least one lift valve displaceably connected to said cam element, said lift valve having a valve stem with a first end;

a flexible enclosing element connected to said first end of said valve stem and rotatably enclosing said cam element;

said first end of said valve stem being guided in a direction of displacement of said valve; and a holder between said enclosing element and said valve stem, said holder having sliding surfaces for guiding on cylinder-head-fixed guide surfaces.

2. The valve drive according to claim 1, wherein said lift valve is mounted in an internal combustion engine.

3. The valve drive according to claim 1, wherein said holder projects over said cam element in an axial direction of said shaft and said sliding surfaces are formed on a projecting region of said holder.

4. The valve drive according to claim 1, wherein said cam element has two axially spaced cam regions and a groove between said cam regions in extension of said sliding surfaces of said holder, and said enclosing element, in a holding region for said valve stem, is formed with a slot corresponding with said groove.

5. The valve drive according to claim 2, wherein said holder comprises a bearing sleeve in said enclosing element and a hinge pin connected to said valve stem and rotatably mounted in said bearing sleeve.

6. The valve drive according to claim 5, wherein said hinge pin is provided with a connecting part connected to said valve stem.

7. The valve drive according to claim 6, wherein said hinge pin and said connecting part have an L-shape.

8. The valve drive according to claim 6, wherein said hinge pin and said connecting part have a T-shape, the connecting part passing through a slot formed in a holding region of said enclosing element and being connected to the valve stem.

9. The valve drive according to claim 1, wherein said valve stem is offset in relation to said cam element in an axial direction of the shaft.

10. The valve drive according to claim 1, wherein said holder has a hinge pin disposed in said enclosing element and an eye formed at said end of said valve stem, wherein said hinge pin passes through said eye and said sliding surfaces are formed on said valve stem.

11. The valve drive according to claim 1, wherein said holder is formed with a bore having an axis lying in the axis of said valve stem.

12. The valve drive according to claim 11, wherein said end of said valve stem is formed with a threaded bore and a fastening screw passes through said bore of said holder.

13. The valve drive according to claim 12, wherein said shaft, in extension of said fastening screw, is formed with a bore enabling access to said fastening screw.

14. The valve drive according to claim 11, wherein said bore of said holder is a threaded bore, and said end of said valve stem is screwed into said threaded bore.

15. The valve drive according to claim 2, wherein said valve stem is formed with sliding surfaces extending up to said first end and guided on cylinder-head-fixed guide surfaces extending in the direction of displacement of said valve.

16. The valve drive according to claim 1, wherein said enclosing element is assigned a holder on both sides thereof, for a respective valve guided at an upper end next to said cam element.

17. The valve drive according to claim 16, wherein two valves are provided between two cam elements, and said holder is one of two holders with a common hinge pin connected to said enclosing element.

18. The valve drive according to claim 1, wherein said valve stem is screwed into at least one of a valve disk and a connecting part.

19. The valve drive according to claim 1, wherein said lift valve includes a valve disk extending obliquely to said valve stem.

20. The valve drive according to claim 1, wherein the direction of displacement of said valve deviates from an orthogonal to an axis of rotation of said driven shaft, and said valve stem is disposed to be displaceable, relative to said cam element, parallel to said driven shaft.

21. The valve drive according to claim 1, wherein an axis of said valve stem is laterally offset from a parallel axial plane of said driven shaft.

22. In combination with the valve drive according claim 1, a cylinder head assembly for an internal combustion engine, comprising:

a cylinder head formed with a semicircular bearing recess for said driven shaft and with a semicircular bearing recess for each said cam element;

said cylinder head being formed with a bore for receiving said valve stem; and guide surfaces formed in a region of said bore for said first end of said valve stem connected to said enclosing element, said guide surfaces extending in the direction of displacement of said valve.

23. The cylinder head assembly according to claim 22, wherein said bore opens laterally into said bearing recess for said cam element.

24. The cylinder head assembly according to claim 22, wherein said cylinder head is formed with a slot, between two bores for two valves, for receiving a common hinge pin.

25. The cylinder head assembly according to claim 22, which comprises guide webs disposed erect in said bearing recess, said guide surfaces being formed on said guide webs, and said bore running through said bearing recess.

26. The cylinder head assembly according to claim 22, wherein two inlet or outlet ducts, respectively provided with a valve, are formed between said two cam elements.

27. The cylinder head assembly according to claim 25, wherein a thickness of said guide webs corresponds maximally to a width of said groove formed in said cam element.

28. The cylinder head assembly according to claim 22, which comprises a guide sleeve inserted into said bore, said guide sleeve having an upper end formed with a slot, and said guide surfaces in said guide sleeve being provided above a height of said slot.

29. In combination with the valve drive according to claim 2, a cylinder head, comprising:

a base element having a bearing web for said driven shaft and having a guide web for said valve;

said guide web being disposed in a region of a bore for receiving said valve stem, and guide surfaces assigned to said guide web for guiding said first end of said valve stem connected to said enclosing element.

30. The cylinder head according to claim 29, wherein a thickness of said guide web corresponds maximally to a width of said groove formed in said cam element.

31. The cylinder head according to claim 29, which comprises a guide sleeve inserted into said bore, said guide sleeve having an upper end formed with a slot, and said guide surfaces in said guide sleeve being provided above a height of said slot.

32. A valve drive comprising:

at least one cam element disposed on a driven shaft;

at least one lift valve displaceable by said cam element in a given direction, said lift valve having a valve stem with a first end;

a flexible enclosing element connecting said first end of said valve stem and said element and biasing said first end of said valve stem to follow said cam element;

said first end of said valve stem being guided against lateral forces relative to the given direction of displacement of said lift valve; and a holder between said enclosing element and said valve stem, said holder having sliding surfaces for guiding on cylinder-head-fixed guide surfaces.

* * * * *